US008943714B2

(12) United States Patent
Hren

(10) Patent No.: US 8,943,714 B2
(45) Date of Patent: Feb. 3, 2015

(54) SHOVEL HAVING A WRISTING DIPPER

(75) Inventor: William J. Hren, Wauwatosa, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 114 days.

(21) Appl. No.: 13/362,939

(22) Filed: Jan. 31, 2012

(65) Prior Publication Data

US 2012/0195730 A1 Aug. 2, 2012

Related U.S. Application Data

(60) Provisional application No. 61/438,475, filed on Feb. 1, 2011.

(51) Int. Cl.

| | |
|---|---|
| ***E02F 3/60*** | (2006.01) |
| ***E02F 3/46*** | (2006.01) |
| ***E02F 3/30*** | (2006.01) |
| ***E02F 3/407*** | (2006.01) |
| ***E02F 9/28*** | (2006.01) |

(52) U.S. Cl.

CPC . *E02F 3/46* (2013.01); *E02F 3/304* (2013.01); *E02F 3/308* (2013.01); *E02F 3/4075* (2013.01); *E02F 3/60* (2013.01); *E02F 9/2883* (2013.01)

USPC ..... 37/398

(58) Field of Classification Search

USPC ..... 37/394–399, 443

See application file for complete search history.

(56) References Cited

U.S. PATENT DOCUMENTS

| | | | | | |
|---|---|---|---|---|---|
| 1,511,114 | A * | 10/1924 | Downie | 414/694 |
| 1,813,110 | A * | 7/1931 | Bauer | 37/443 |
| 2,873,871 | A * | 2/1959 | Waite | 414/694 |
| 3,184,085 | A * | 5/1965 | Randall et al. | 414/694 |
| 3,452,890 | A * | 7/1969 | Learmont | 414/694 |
| 3,843,095 | A * | 10/1974 | Rupert | 74/89.22 |
| 3,933,260 | A * | 1/1976 | Kronlokken et al. | 414/694 |
| 4,077,140 | A * | 3/1978 | Branconi | 37/443 |
| 4,167,072 | A * | 9/1979 | Johansson | 37/395 |
| 4,278,393 | A * | 7/1981 | Baron | 414/690 |
| 5,251,389 | A * | 10/1993 | Bessey | 37/398 |
| 5,499,463 | A * | 3/1996 | Profio et al. | 37/398 |
| 6,240,661 | B1 * | 6/2001 | Seibold | 37/395 |
| 6,434,862 | B1 * | 8/2002 | Hren | 37/398 |
| 7,658,023 | B2 * | 2/2010 | Wallett | 37/345 |
| 2005/0150141 | A1 * | 7/2005 | Suzik et al. | 37/395 |
| 2007/0107269 | A1 * | 5/2007 | Hren et al. | 37/398 |
| 2007/0266601 | A1 * | 11/2007 | Claxton | 37/396 |
| 2009/0133297 | A1 * | 5/2009 | Lee | 37/443 |

OTHER PUBLICATIONS

First Office Action from the Australian Intellectual Property Office for Application No. 2012200525 dated Mar. 19, 2014 (3 pages).

* cited by examiner

*Primary Examiner* — Matthew D Troutman

(74) *Attorney, Agent, or Firm* — Michael Best & Friedrich LLP

(57) ABSTRACT

A rope shovel includes a wristing dipper arrangement. The shovel comprises a base, a boom extending from the base, the boom having a first end attached to the base and a second end remote from the base. The shovel further comprises a pulling mechanism mounted on the second end of the boom and a boom attachment pivotally mounted on the boom and attached to a dipper, the boom attachment including an actuator coupled to the dipper.

21 Claims, 4 Drawing Sheets

SHOVEL HAVING A WRISTING DIPPER

CROSS-REFERENCE TO RELATED APPLICATIONS

This application claims the benefit of and priority to U.S. Provisional Patent Application No. 61/438,475, filed Feb. 1, 2011, the entire contents of which are hereby incorporated by reference herein.

BACKGROUND

The present invention relates to rope shovels used in the mining and the construction industries.

In the mining field, and in other fields in which large volumes of materials must be collected and removed from a work site, it is typical to employ a power shovel including a large dipper for shoveling the materials from the work site. After filling the dipper with material, the shovel swings the dipper to the side to dump the material into a material handling unit, such as a dump truck or a local handling unit (e.g., crusher, sizer, or conveyor). Generally, the shovels used in the industry include hydraulic shovels and electric rope shovels. Conventional electric rope shovels typically include a dipper digging component rigidly connected to the dipper handle. This configuration allows the digging attachment to have only two degrees of freedom of movement in the dig path of the dipper: hoist and crowd.

SUMMARY

In one embodiment, a mining shovel includes a base and a boom extending from the base. The boom includes a lower end attached to the base and an upper end remote from the base. A pulling mechanism is mounted on the upper end of the boom. A boom attachment has a first end pivotally coupled to the boom and a second end attached to a dipper, the dipper moveably supported by the pulling mechanism. A dipper actuator is coupled between the boom attachment and the dipper. The dipper actuator is operable to pivot the dipper relative to the boom attachment.

In other embodiments, a mining shovel includes a base, a boom having a first boom end coupled to the base and a second boom end, and a pulling mechanism at the second boom end. A boom attachment includes a first portion coupled to the boom between the first boom end and the second boom end, and a second portion pivotally coupled to the first portion and supported by the pulling mechanism. A dipper is coupled to the second portion of the boom attachment.

In still other embodiments, a mining shovel includes a base, a boom having a first boom end coupled to the base and a second boom end, and a pulling mechanism at the second boom end. A boom attachment has a first portion coupled to the boom between the first boom end and the second boom end, and a second portion pivotally coupled to the first portion and supported by the pulling mechanism. A boom attachment actuator extends between the boom attachment and at least one of the base and the boom. The boom attachment actuator is operable to pivot the boom attachment relative to the boom. A dipper is pivotally coupled to the second portion of the boom attachment, and a dipper actuator is coupled between the boom attachment and the dipper and is operable to pivot the dipper relative to the boom attachment.

Other aspects of the invention will become apparent by consideration of the detailed description and accompanying drawings.

Figure 1:
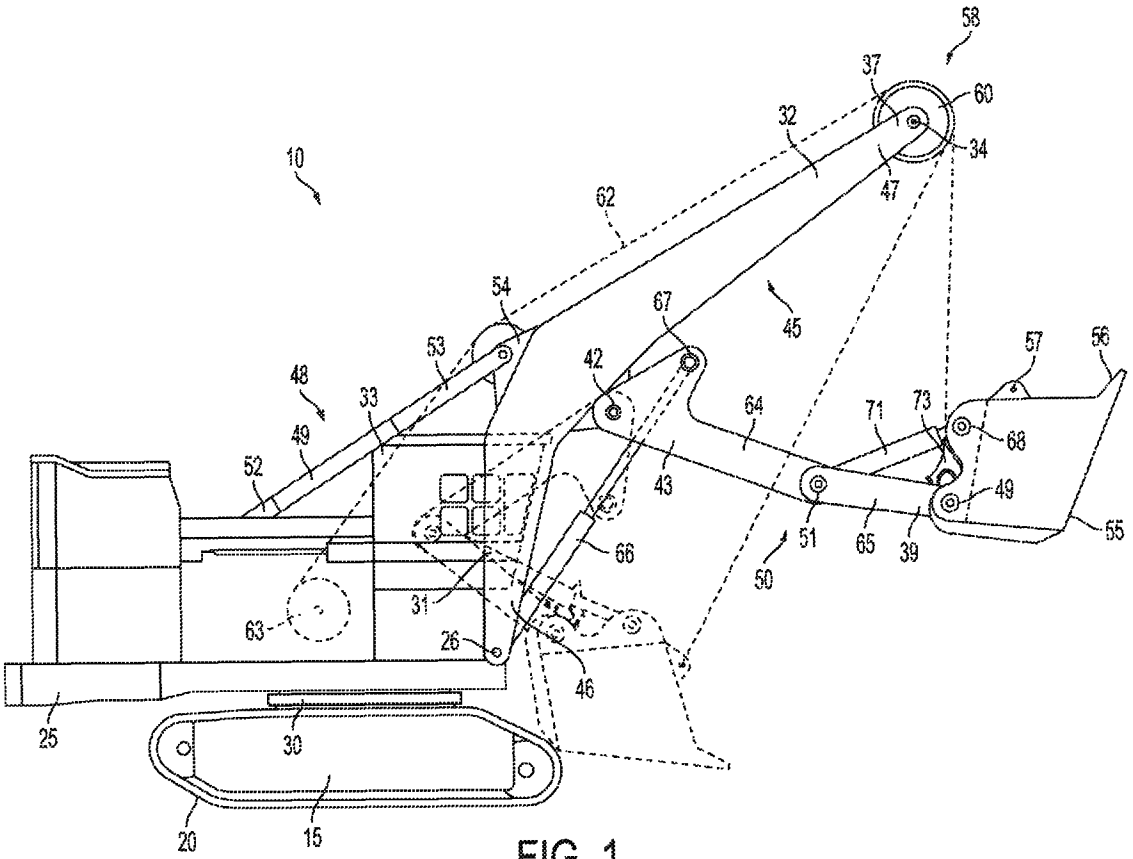
FIG. 1 is a side view of a rope shovel according to an embodiment of the invention.

It is to be understood that the invention is not limited in its application to the details of the construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION

Conventional electric rope shovels cannot "wrist" the dipper during the initial penetration of the bank of material like hydraulic shovels can. Hydraulic shovels typically possess three degrees of freedom while digging: hoist, crowd, and bucket wrist. These hydraulic shovels demonstrate excellent initial bank penetration at the lower dig heights. Hydraulic shovels, however, lose efficiency later in the dig path cycle. As they rake the bank at higher dig heights, they struggle to keep dig forces high at the bucket teeth. The reason for the weak effort higher in the bank is that the hydraulic shovels must lift the combined weights of the boom, handle, dipper, and material, whereas the electric shovel does not need to lift the boom.

On the other hand, electric rope shovels demonstrate excellent dig forces higher in the bank because they utilize the boom point sheave or pulley located high above the ground and away from the dipper. Electric rope shovels use this boom point sheave as a pulley, translating hoist drum torque into rope bail pull in a direction that directly lifts and hoists the dipper load through the bank and into the air. This generates very efficient and powerful dig forces at the dipper teeth. However, because the dipper in conventional electric rope shovels is fixed relative to the dipper arm, the ability to create high digging forces when the dipper is low to the ground is limited by the fixed geometry of the dipper arm, the boom, and the relative locations of the shipper shaft and the boom point sheave.

Thus, there is a need for an electric rope shovel that incorporates the hoist force of the boom point pulley of an electric shovel, with the dipper wristing feature of a hydraulic shovel. This improved electric shovel provides a highly efficient and versatile digging attachment that can operate efficiently in all types of bank conditions.

FIGS. 1-4 illustrate rope shovels 10 according to various embodiments of the present invention. Like parts are identified using the same reference numbers. Referring to FIG. 1, the rope shovel 10 includes a lower base 15 that is supported on drive tracks 20, and an upper base 25 (also called a deck) positioned on a rotational structure 30 that is mounted to the lower base 15. The rotational structure 30 allows rotation of the upper base 25 relative to the lower base 15. The upper base 25 includes, among other elements, an operating area 33 in which an operator or a driver sits to operate the rope shovel 10.

The rope shovel 10 further includes a boom 45 extending upwardly and forwardly from the upper base 25. The boom 45 includes a first end 46 coupled to the upper base 25 and a distal second end 47. The illustrated boom 45 is curved and has "banana" or a "V" shape, while the curved boom 45 offers certain advantages, other embodiments may include a substantially straight boom. The boom 45 includes a lower attachment point 26 where the boom 45 is coupled to the upper base 25 by pin joints or other suitable attachment mechanisms. The boom 45 also includes an upper attachment point 54 to which a support strut 48 is connected. The support strut 48 extends downwardly and rearwardly from the upper attachment point 54 and is coupled to the upper base 25. Together the strut 48, upper base 25, and boom 45 define a substantially rigid triangulated structure that supports the boom 45 in an upright orientation.

The illustrated curved boom 45 includes a generally vertical first portion 31 that extends generally upwardly from the base 25, and an angled second portion 32 that extends at an angle from the first portion 31 toward the second end 47 of the boom. The first portion 31 of the boom 45 is angled with respect to the second portion 32 of the boom. In some embodiments, the angle between the first portion 31 and the second portion 32 of the boom can be between about one hundred and twenty degrees and about one hundred and sixty degrees. More specifically, the angle between the first portion 31 and the second portion 32 can be between approximately one hundred and sixty degrees. In other words, the second portion 32 of the boom 45 is offset between about twenty and about sixty degrees from the first portion 31 of the boom 45. In particular, the offset between the second portion 32 of the boom 45 and the first portion 31 can be twenty degrees. The illustrated boom 45 is of a one piece construction combining the first and the second portions 31, 32 of the boom. In other embodiments, the boom 45 can be formed from two or more separate pieces joined by welding, pin joints, fasteners, or any other attachment mechanisms.

The rope shovel 10 also includes a digging attachment comprising a boom attachment 50 (also called a boom handle) pivotally coupled to the boom 45 and a dipper 55 pivotally coupled to the boom attachment 50. The dipper 55 includes dipper teeth 56 and is used to excavate the desired work area, collect material, and transfer the collected material to a desired location (e.g., a material handling vehicle). The boom attachment 50 is pivotally mounted to the boom 45 at a first pivot location 42, and the dipper 55 is pivotally mounted to the boom attachment 50 at a second pivot location 49. In the illustrated embodiment, the first pivot location 42 is positioned generally where the first portion 31 and the second portion 32 of the boom 45 connect or intersect.

The illustrated boom attachment 50 includes a first or upper arm 64 and a second or lower arm 65 pivotally coupled to the upper arm at a third pivot location 51. The upper arm 64 is pivotally coupled to the boom 45 at the first pivot location 42, and the dipper 55 is pivotally coupled to the lower arm 65 at the second pivot location 49. The pivotal connections between the upper and lower arms 64, 65 and the dipper 55 provide a multi-degree-of-freedom system that allows the dipper 55 to be maneuvered through a range of motion that includes the dashed-line representation of the upper and lower arms 64, 65 and the dipper 55 in FIG. 1. This range of motion is greater than a conventional rope shovel having a rigid boom attachment 50 and a fixed dipper 55. While the illustrated embodiment shows the first, second, and third pivot locations 42, 49, and 51 as pin joints, other mechanical connections such as cams, linkages, gear sets, and the like may also be used to achieve the desired relative movement between the upper arm 64, the lower arm 65, and the dipper 55. In this regard, the "pivot locations" may not necessarily be located on or coincide with a structural portion of the rope shovel 10, but may instead be located at a fixed or moveable location in space as defined by the specific mechanical connection between the respective components.

The illustrated rope shovel 10 includes a plurality of hydraulic cylinders for controlling movement of the boom attachment 50 and the dipper 55. The boom attachment 50 is controlled by a first actuator in the form of a first hydraulic cylinder 66 having a first end coupled to the base 25 and a second end coupled to a mounting point 67 on the upper arm 64 of the boom attachment 50. The dipper 55 is controlled by a second actuator in the form of a second hydraulic cylinder 71 having a first end coupled to the third pivot location 51 and a second end coupled to a mounting point 68 on the dipper 55. The first hydraulic cylinder 66 is therefore operable to pivot the upper arm 64 about the first pivot location 42 relative to the base 25 and boom 45, and the second hydraulic cylinder 71 is operable to pivot the dipper 55 about the second pivot location 49 relative to the lower arm 65.

The second hydraulic cylinder 71 provides a controllable force on the dipper 55 for creating forward and backward movement of the dipper 55. Thus, the second hydraulic cylinder 71 allows the dipper 55 to "wrist" during travel through the digging path of the shovel 10. Wristing the dipper during penetration of the bank of material allows for quicker and more efficient collection of material and gives the shovel operator the versatility needed for selective and forceful digging in the bank. It should be noted that second hydraulic cylinder 71 can be substituted with other mechanical devices and structures. For example, pivoting rack and pinion systems, pneumatic cylinders, pistons, electric motors and the like can also be used to move the dipper 55. These alternative mechanisms can also be used to replace the first hydraulic cylinder 66. Thus, the entire digging attachment can be manufactured without any hydraulics, if desired.

The boom 45 includes a pulling mechanism 58 mounted at the second end 47 of the boom 45. In some embodiments, the pulling mechanism 58 comprises a pulley or boom sheave 60. A flexible hoist rope 62 is attached to a connecting portion 73 of the boom attachment 50 and at least partially supports the boom attachment 50 and the dipper 55. In other embodiments (not shown), the hoist rope 63 can be directly attached to the dipper 55. For example, the rope 63 can be attached to the dipper connecting element 57. The flexible hoist rope extends from the connecting portion 73 (or the connecting element 57), over the sheave 60 and is then wrapped around a hoist drum 63 that is mounted on the upper base 25 of the electric shovel 10. The flexible hoist rope 62 may be or include one or more than one rope that may pass over the sheave 60 multiple times. In this regard, the connecting portion 73 may be or include an equalizer capable of equalizing the load on the various ropes 62 or rope portions that support the dipper 55. The hoist drum 63 is powered by an electric motor (not shown) that provides turning torque to the drum 63 through a geared hoist transmission (not shown).

The sheave 60 is rotatably coupled to the second end 47 of the boom 45 between a pair of sheave support members 37 located at the second end 47 of the boom 45 (only one of the sheave support members 37 is visible in FIG. 1). A rod or a load pin 34 extends between the sheave support members 37 and through the sheave 60, thereby rotatably coupling the sheave 60 to the boom 45. Thus, the sheave 60 rotates about the rod or the load pin 34. In other embodiments, alternative mechanisms for connecting the sheave 60 to the boom 45 can be used. Rotation of the hoist drum 63 reels in and pays out the hoist rope 62, which travels over the sheave 60 and raises and lowers the dipper 55.

A common feature of the illustrated embodiments is that if the hoist rope 62 is removed, the boom attachment 50 will have one unrestrained degree-of-freedom associated with the third pivot location 51. Thus, the first and second hydraulic cylinders 66, 71 cannot, by themselves, fully coordinate movement of the boom attachment 50 and the dipper 55. Rather, it is combined operation of the first and second hydraulic cylinders 66, 71 and the hoist rope 62 that allows for complete control of the boom attachment 50 and dipper 55.

In operation, the boom attachment 50 that extends from the boom 45 is driven by the first hydraulic cylinder 66 positioned on the base 25. Using that force, the upper 64 arm of the boom attachment drives the lower arm 65 by utilizing the pinned connection at the third pivot location 51. Rotating the upper arm 64 thrusts the lower arm 65 and the dipper 55 into the bank of material. This constitutes crowd force. Rotation or wristing of the dipper 55 is provided by the second hydraulic cylinder 71, which is mounted between the boom attachment 50 and the dipper 55. At the same time, the pulley 60 and hoist drum 63 cooperate to apply forces to the hoist rope 62 that lift the dipper 55 through the bank of material and into the air. The dipper 55 is simultaneously driven by the boom attachment 50 and the hoist force generated by the rope 62 driven by the hoist drum 63 and over the pulley 60. Thus, the shovel 10 possesses three degrees of digging freedom: hoist, crowd, and bucket wrist.

The above-described combined and coordinated operation of the hoist drum 63 and hoist rope 62 with the first and second hydraulic cylinders 66, 71 provide efficient digging forces throughout the range of motion of the boom attachment 50 and dipper 55. For example, when the boom attachment 50 and dipper 55 are in the position shown in dashed lines in FIG. 1, compared to the hoist rope 62, the hydraulic cylinders 66, 71 are in a position of superior mechanical advantage for driving the dipper 55 generally forwardly into the bank. After the boom attachment 50 and dipper 55 are pushed into the bank and moved further away from the lower base 15, compared to the hydraulic cylinders 66, 71, the hoist rope 62 occupies a position of superior mechanical advantage for raising the dipper generally vertically through the bank of material. Thus, by coordinating operation of the hydraulic cylinders 66, 71 and the hoist rope 62, strong, efficient dig forces can be maintained throughout the range of motion of the boom attachment 50 and dipper 55.

Figure 2:
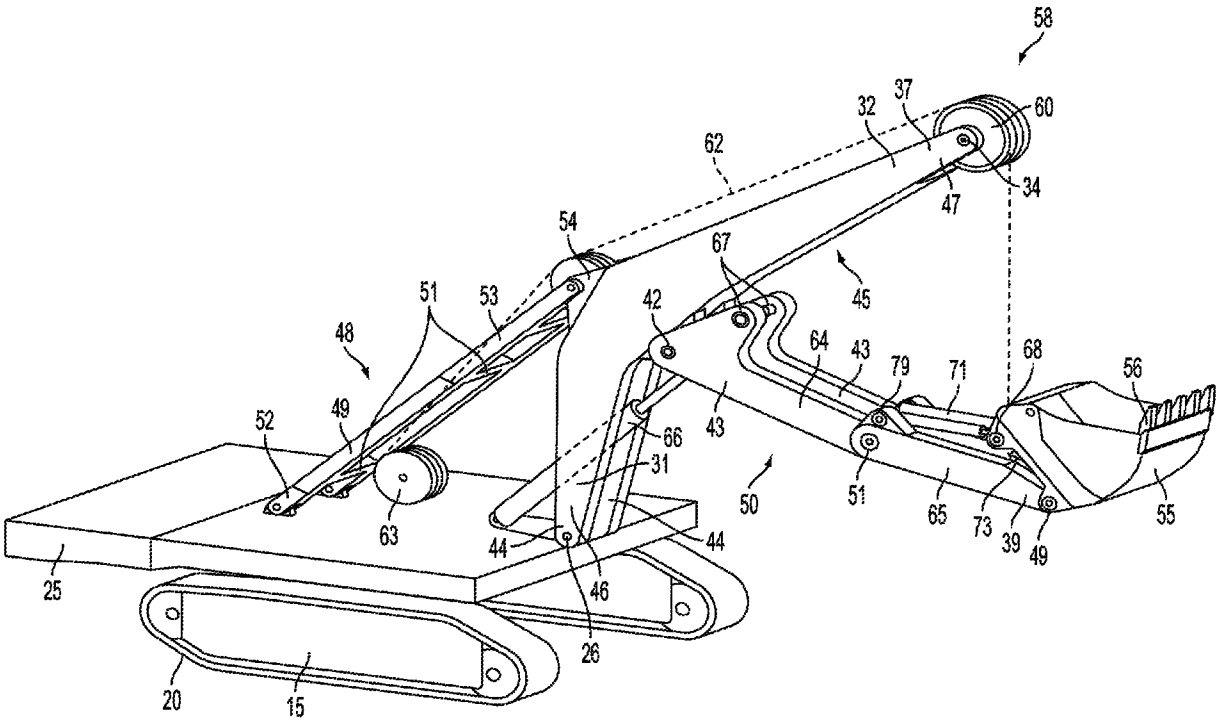
FIG. 2 is a perspective view of an electric rope shovel according to another embodiment of the invention.
Figure 3:
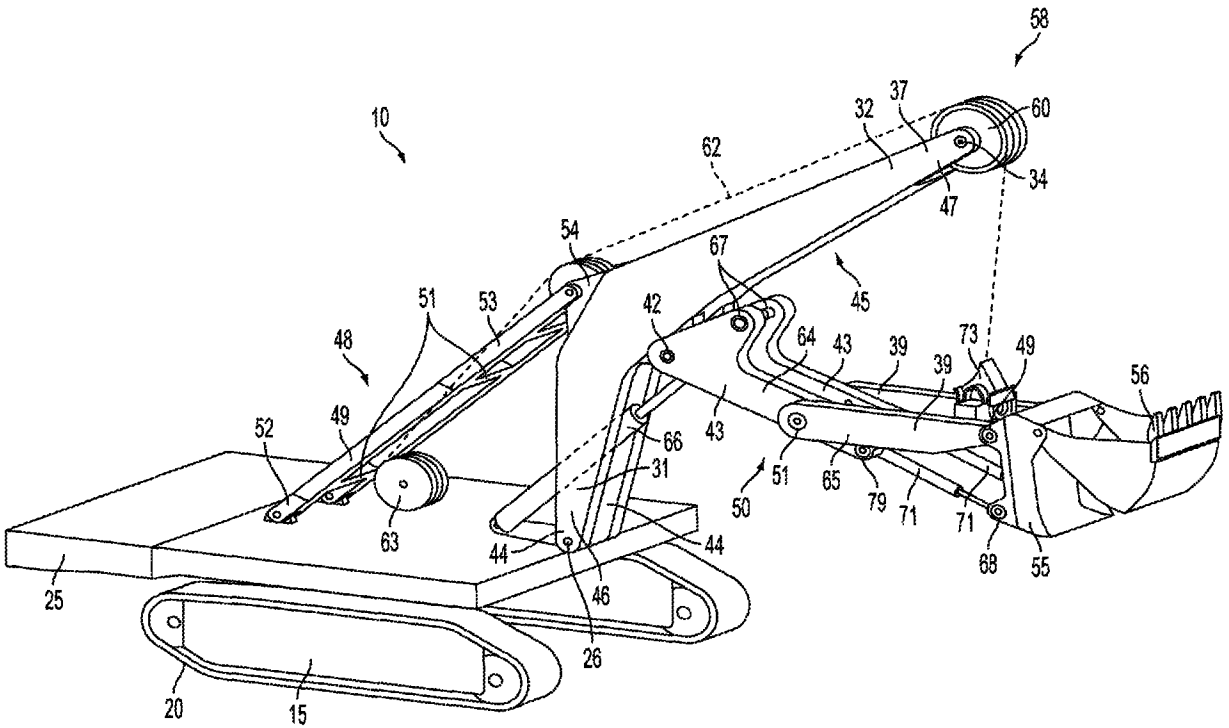
FIG. 3 is a perspective view of an electric rope shovel according to yet another embodiment of the invention.
Figure 4:
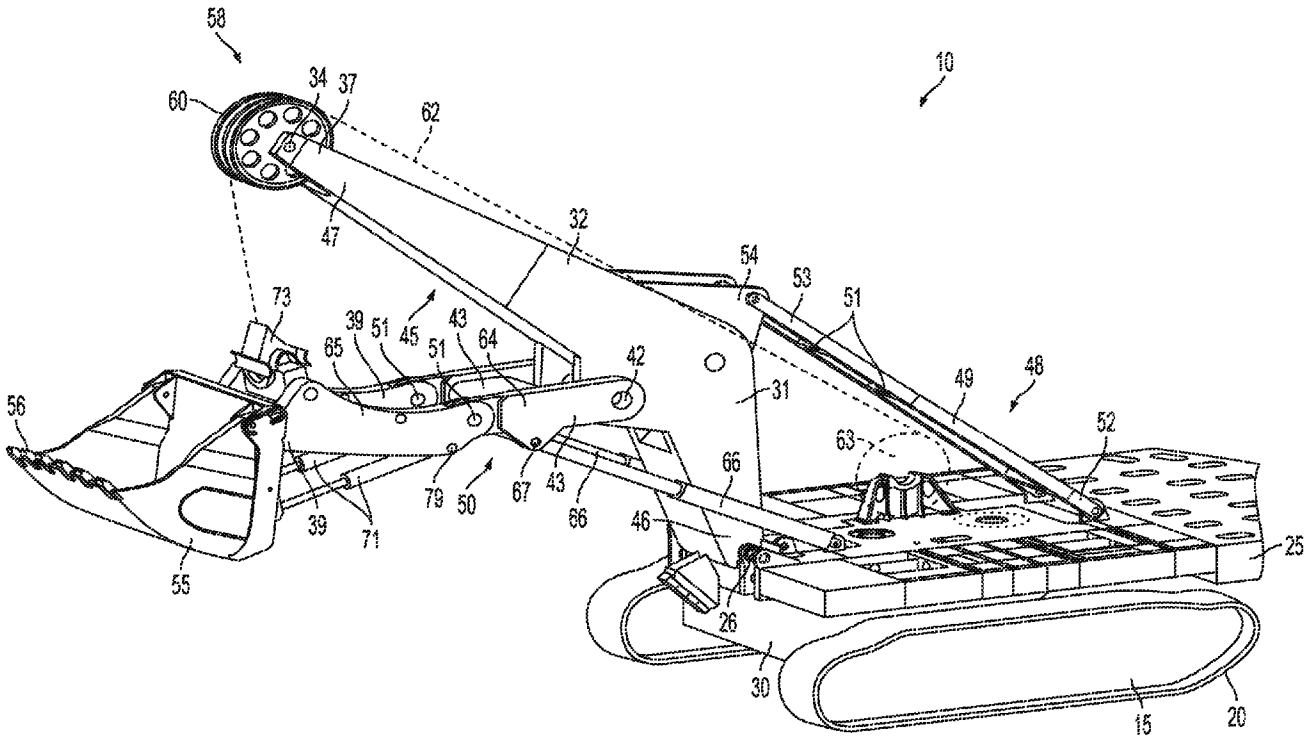
FIG. 4 is a perspective view an electric rope shovel according to another embodiment of the invention.

FIGS. 2-4 illustrate alternative embodiments of the rope shovel 10 that, other than the specific differences discussed below, are generally similar in configuration and operation to the rope shovel 10 of FIG. 1.

Because FIGS. 2-4 are perspective views, the specific structure of the strut 48 is more fully shown in FIGS. 2-4. The strut 48 entirely replaces the gantry structure used in many conventional shovels. In some embodiments, the strut 48 includes two parallel strut legs 49 coupled by rigid-connect members 51. One end 52 of the strut 48 is coupled to the base 25 at a location spaced apart from the first end 46 of the boom 45. A second end 53 of the strut 48 is coupled to the boom 45 by connecting each strut leg 49 to the upper attachment point 54 of the boom 45. In some embodiments, the second end 53 of the strut 48 is coupled to the general area where the first portion 31 and the second portion 32 of the boom 45 connect or intersect. The strut 48 supports the boom 45 in the upright position.

In some embodiments, the strut 48 is pivotally connected to the base 25 and to the boom 45 via moving pin joints or other types of connectors. During shovel operation, the strut 48 can be exposed to both compression and tension loads and forces. Therefore, the strut 48 can be provided with shock absorbing connectors such as various types of spring assemblies incorporated into the pinned attachment joints between the strut 48, the base 25, and the boom 45. These shock absorbing connectors can reduce the overall stiffness of the strut assembly when compression and tension forces are acting on the strut, thereby reducing or eliminating shock loading and in turn reducing the overall stresses experienced by the various components.

FIGS. 2-4 also show that the upper arm 64 comprises a pair of spaced apart upper arm members 43, and the lower arm 65 comprises a pair of spaced apart lower arm members 39. The embodiments of FIGS. 2 and 3 include a boom 45 having a pair of spaced apart boom members 44. The two boom members 44 are attached to and extend from the upper base 25, and the first hydraulic cylinder 66 extends through the space between the two boom members 44 and between the pair of upper arm members 43 for coupling to the mounting point 67. The embodiment of FIG. 4, on the other hand, includes a substantially solid boom first portion 31 and a pair of first hydraulic cylinders 66 are positioned on each side of the boom 45 and extend to mounting points 67 associated with each of the upper arm members 43. As also shown in FIG. 4, the mounting points 67 are on the underside of the upper arm members 43, or below an imaginary line drawn between the first and third pivot locations 42, 51. In FIGS. 1-3, the mounting point(s) 67 are located above an imaginary line drawn between the first and third pivot locations 42, 51. Thus, the specific configuration and arrangement of the first hydraulic cylinder (s) 66 can vary depending upon, among other things, the specific configuration of the boom 45 and the upper arm 64.

Similarly, the specific configuration and arrangement of the second hydraulic cylinder 71, which can include more than one hydraulic cylinder, can vary depending upon the specific configuration and arrangement of the lower arm 65 and the dipper 55. For example, in FIG. 1, the second hydraulic cylinder 71 has one end coupled to the third pivot location 51. In other embodiments, such as the embodiments of FIGS. 2 and 4, the second hydraulic cylinder(s) 71 can be coupled to the lower arm 65 at a second mounting location 79. The second mounting location 79 can be either above (FIG. 2) or below (FIG. 4) an imaginary line drawn between the second and third pivot locations 49, 51. One benefit of the embodiments of FIGS. 1 and 2, where the second hydraulic cylinder 71 is positioned above the lower arm 65, is that if the lower arm 65 accidentally strikes a loading vehicle or other structure during operation, the hydraulic cylinder 71 is less likely to be damaged. In still other embodiments, such as the embodiment of FIG. 3, the second hydraulic cylinders 71 can be coupled to the upper arm 64, such that the second mounting location 79 is located on the upper arm 64. Other embodiments can include various other intermediate structures through which the second hydraulic cylinders 71 can be attached to the upper arm 64 or the lower arm 65. Further, in some embodiments, the hydraulic cylinders 71 are attached to the lower portion of the dipper 55 (FIGS. 3 and 4). In other embodiments, the hydraulic cylinders 71 can be attached to the upper portion of the dipper 55 (FIGS. 1 and 2).

Various features and advantages of the invention are set forth in the following claims.

What is claimed is:

1. A mining shovel comprising:

a base;

a boom extending from the base, the boom having a lower end attached to the base and an upper end remote from the base;

a pulling mechanism mounted on the upper end of the boom;

a boom attachment having a first end pivotally coupled to the boom and a second end;

a boom attachment actuator extending between the boom attachment and at least one of the base and the boom, wherein the boom attachment actuator is operable to pivot the boom attachment relative to the boom;

a dipper pivotally connected to the second end of the boom attachment for pivoting movement about the second end of the boom attachment in a first direction and a second direction opposite the first direction, the dipper moveably supported by the pulling mechanism; and a dipper actuator coupled between the boom attachment and the dipper and operable to selectively pivot the dipper relative to the boom attachment in the first direction and the second direction.

2. The mining shovel of claim 1, wherein the boom attachment actuator is pivotally coupled to the at least one of the base and the boom and to the boom attachment.

3. The mining shovel of claim 1, wherein the boom includes a first portion having two parallel boom members extending upwardly from the base, and a second portion extending upwardly and forwardly from the first portion.

4. The mining shovel of claim 3, wherein the boom attachment actuator is positioned between the two parallel boom members.

5. The mining shovel of claim 1, wherein movement of the dipper is controlled by simultaneous operation of the boom attachment actuator and the pulling mechanism.

6. The mining shovel of claim 1, wherein the boom attachment includes a first portion pivotally coupled to the boom and a second portion pivotally coupled to the first portion.

7. The mining shovel of claim 6, wherein the dipper is pivotally coupled to the second portion.

8. The mining shovel of claim 7, wherein the pulling mechanism is coupled to one of the dipper and the second portion for supporting the second end of the boom attachment.

9. The mining shovel of claim 7, wherein the dipper actuator is coupled between the second portion and the dipper.

10. The mining shovel of claim 1, wherein the pulling mechanism includes a sheave rotatably coupled to the second end of the boom and a rope extending from the base, over the sheave, and coupled to the second end of the boom attachment.

11. A mining shovel comprising:

a base;

a boom having a first boom end coupled to the base and a second boom end;

a pulling mechanism at the second boom end;

a boom attachment having a first portion coupled to the boom between the first boom end and the second boom end, and a second portion pivotally coupled to the first portion and supported by the pulling mechanism;

a dipper coupled to the second portion of the boom attachment; and a dipper actuator coupled between the boom attachment and the dipper and operable to pivot the dipper with respect to the second portion.

12. The mining shovel of claim 11, wherein the dipper is pivotally coupled to the second portion of the boom attachment.

13. The mining shovel of claim 11, further comprising a boom attachment actuator extending between the boom attachment and at least one of the base and the boom, wherein the boom attachment actuator is operable to pivot the boom attachment relative to the boom.

14. The mining shovel of claim 11, wherein the pulling mechanism includes a sheave rotatably mounted to the second boom end and a rope extending from the base, over the sheave, and generally downwardly to support the second portion of the boom attachment.

15. The mining shovel of claim 11, wherein the dipper actuator is coupled between the first portion of the boom attachment and the dipper.

16. The mining shovel of claim 11, wherein the dipper actuator is coupled between the second portion of the boom attachment and the dipper.

17. The mining shovel of claim 11, wherein the dipper actuator positioned below the second portion of the boom attachment.

18. A mining shovel comprising:

a base;

a boom having a first boom end coupled to the base and a second boom end;

a pulling mechanism at the second boom end;

a boom attachment having a first portion coupled to the boom between the first boom end and the second boom end, and a second portion pivotally coupled to the first portion and supported by the pulling mechanism;

a boom attachment actuator extending between the boom attachment and at least one of the base and the boom, the boom attachment actuator operable to pivot the boom attachment relative to the boom;

a dipper pivotally coupled to the second portion of the boom attachment; and a dipper actuator coupled between the boom attachment and the dipper and operable to pivot the dipper relative to the boom attachment.

19. The mining shovel of claim 18, wherein the boom attachment actuator is coupled to the first portion of the boom attachment.

20. The mining shovel of claim 18, wherein the dipper actuator is coupled between the second portion of the boom attachment and the dipper.

21. The mining shovel of claim 18, wherein the pulling mechanism includes a sheave rotatably mounted to the second boom end and a rope extending from the base, over the sheave, and coupled to the dipper via a dipper connecting element.

* * * * *